US006525634B2

(12) United States Patent
Laskaris et al.

(10) Patent No.: US 6,525,634 B2
(45) Date of Patent: Feb. 25, 2003

(54) PERMANENT MAGNET ASSEMBLY AND METHOD OF MAKING THEREOF

(75) Inventors: Evangelos Trifon Laskaris, Niskayuna, NY (US); Michael Anthony Palmo, Ballston Spa, NY (US); Kathleen Melanie Amm, Clifton Park, NY (US); Paul Shadforth Thompson, Stephentown, NY (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 10/157,965

(22) Filed: May 31, 2002

(65) Prior Publication Data

US 2002/0180573 A1 Dec. 5, 2002

Related U.S. Application Data

(62) Division of application No. 09/824,245, filed on Apr. 3, 2001.

(51) Int. Cl.[7] ..... H01F 1/00; H01F 3/00; H01F 7/00

(52) U.S. Cl. ..... 335/296; 335/284; 335/302; 335/306

(58) Field of Search ..... 335/216, 284, 335/296–306; 324/318, 319, 320

(56) References Cited

U.S. PATENT DOCUMENTS

| | | | | |
|---|---|---|---|---|
| 4,496,395 A | | 1/1985 | Croat | |
| 4,540,453 A | | 9/1985 | Boredelon et al. | |
| 4,818,966 A | | 4/1989 | Miyamoto et al. | |
| 5,252,924 A | | 10/1993 | Sakurai et al. | |
| 5,283,544 A | | 2/1994 | Sakurai et al. | |
| 5,317,297 A | | 5/1994 | Kaufman et al. | |
| 5,343,180 A | * | 8/1994 | Fukumoto et al. | 335/216 |
| 5,383,978 A | | 1/1995 | Yamamoto et al. | |
| 5,631,616 A | | 5/1997 | Ohta et al. | |
| 5,680,086 A | | 10/1997 | Allis et al. | |
| 6,120,620 A | | 9/2000 | Benz et al. | |
| 6,157,281 A | | 12/2000 | Katznelson et al. | |
| 6,163,240 A | | 12/2000 | Zuk et al. | |
| 6,259,252 B1 | | 7/2001 | Laskaris et al. | |

OTHER PUBLICATIONS

U.S. patent application Ser. No. 09/738,856, Laskaris et al., filed Feb. 21, 2002.

U.S. patent application Ser. No. 09/203,214, Laskaris et al., filed Nov. 30, 1998.

* cited by examiner

*Primary Examiner*—Ramon M. Barrera
(74) *Attorney, Agent, or Firm*—Foley & Lardner

(57) ABSTRACT

An imaging apparatus, such as an MRI system, contains at least one layer of soft magnetic material between the yoke and each permanent magnet. This imaging apparatus may be operated without pole pieces due to the presence of the soft magnetic material. The permanent magnets may be fabricated by magnetizing unmagnetized alloy bodies after the unmagnetized alloy bodies have been attached to the yoke.

21 Claims, 13 Drawing Sheets

PERMANENT MAGNET ASSEMBLY AND METHOD OF MAKING THEREOF

This application is a divisional of application Ser. No. 09/824,245 filed Apr. 3, 2001.

BACKGROUND OF THE INVENTION

This invention relates generally to magnetic imaging systems and specifically to a magnetic resonance imaging (MRI) magnet assembly.

There are various magnetic imaging systems which utilize permanent magnets. These systems include magnetic resonance imaging (MRI), magnetic resonance therapy (MRT) and nuclear magnetic resonance (NMR) systems. MRI systems are used to image a portion of a patient's body. MRT systems are generally smaller and are used to monitor the placement of a surgical instrument inside the patient's body. NMR systems are used to detect a signal from a material being imaged to determine the composition of the material.

These systems often utilize two or more permanent magnets directly attached to a support, frequently called a yoke. An imaging volume is providing between the magnets. A person or material is placed into an imaging volume and an image or signal is detected and then processed by a processor, such as a computer. The magnets are sometimes arranged in an assembly 1 of concentric rings of permanent magnet material, as shown in FIG. 1. For example, there may be two rings 3, 5 separated by a ring of non-magnetic material 7 in the gap between the magnet rings 3, 5. The ring of non-magnetic material 7 extends all the way through the magnet assembly 1 parallel to the direction of the magnetic field. The assembly 1 also contains a hole 9 adapted to receive a bolt which will fasten the assembly 1 to the yoke.

The prior art imaging systems also contains pole pieces and gradient coils adjacent to the imaging surface of the permanent magnets facing the imaging volume. The pole pieces are required to shape the magnetic field and to decrease or eliminate undesirable eddy currents which are created in the yoke and the imaging surface of the permanent magnets.

However, the pole pieces also interfere with the magnetic field generated by the permanent magnets. Thus, the pole pieces decrease the magnitude of the magnetic field generated by the permanent magnets that reaches the imaging volume. Thus, a larger amount of permanent magnets are required to generate a magnetic field of an acceptable strength in the imaging volume, especially in an MRI system, due to the presence of the pole pieces. The larger amount of the permanent magnets increases the cost of the magnets and increases the complexity of manufacture of the imaging systems, since the larger magnets are bulky and heavy.

Since the permanent magnets are strongly attracted to iron, the imaging systems, such as MRI systems, containing permanent magnets are assembled by a special robot or by sliding the permanent magnets along the portions of the yoke using a crank. If left unattached, the permanent magnets become flying missiles toward any iron object located nearby. Therefore, the standard manufacturing method of such imaging systems is complex and expensive because it requires a special robot and/or extreme precautions.

BRIEF SUMMARY OF THE INVENTION

In accordance with one aspect of the present invention, there is provided an assembly for an imaging apparatus comprising at least one layer of soft magnetic material, and a body of a first material suitable for use as a permanent magnet having a first surface and a shaped second surface, wherein the first surface is attached over the at least one layer of the soft magnetic material and the second surface is adapted to face an imaging volume of the imaging apparatus.

In accordance with another aspect of the present invention, there is provided a magnetic imaging system, comprising a yoke comprising a first portion, a second portion and at least one third portion connecting the first and the second portions such that an imaging volume is formed between the first and the second portions, a first magnet assembly attached to the first yoke portion, wherein the first magnet assembly comprises at least one permanent magnet containing an imaging surface exposed to the imaging volume and at least one layer of a soft magnetic material between a back surface of the at least one permanent magnet and the first yoke portion, and a second magnet assembly attached to the second yoke portion, wherein the second magnet assembly comprises at least one permanent magnet containing an imaging surface exposed to the imaging volume and at least one layer of a soft magnetic material between a back surface of the at least one permanent magnet and the second yoke portion.

In accordance with another aspect of the present invention, there is provided an assembly suitable for use as a permanent magnet, comprising a base body suitable for use as a permanent magnet having a first and second major surfaces, and a hollow ring body suitable for use as a permanent magnet having a first and second major surfaces, where a first major surface of the hollow ring body is formed over a second major surface of the base body.

In accordance with another aspect of the present invention, there is provided a method of making an imaging device, comprising providing a support comprising a first portion, a second portion and at least one third portion connecting the first and the second portions such that an imaging volume is formed between the first and the second portions, attaching a first precursor body comprising a first unmagnetized material to the first support portion, attaching a second precursor body comprising a second unmagnetized material to the second support portion, magnetizing the first unmagnetized material to form a first permanent magnet body after the step of attaching the first precursor body, and magnetizing the second unmagnetized material to form a second permanent magnet body after the step of attaching the second precursor body.

In accordance with another aspect of the present invention, there is provided a method of making a magnet assembly, comprising placing a plurality of blocks of a material suitable for use as a permanent magnet into a mold cavity having a non-uniform cavity surface contour, filling the mold cavity with an adhesive substance to bind the plurality of blocks into a first assembly comprising a unitary body, such that a first surface of the unitary body forms a substantially inverse contour of the non-uniform mold cavity surface, and removing the first assembly from the mold cavity.

In accordance with another aspect of the present invention, there is provided a method of imaging a portion of a patient's body using magnetic resonance imaging, comprising providing a magnetic image resonance system comprising a yoke comprising a first portion, a second portion and at least one third portion connecting the first and the second portions such that an imaging volume is formed between the first and the second portions, a first magnet assembly attached to the first yoke portion, wherein the first magnet assembly comprises at least one permanent magnet containing an imaging surface exposed to the imaging volume and at least one soft magnetic material layer between a back surface of the at least one permanent magnet and the first yoke portion, and a second magnet assembly attached to the second yoke portion, wherein the second magnet assembly comprises at least one permanent magnet containing an imaging surface exposed to the imaging volume and at least one soft magnetic material layer between a back surface of the at least one permanent magnet and the second yoke portion, detecting an image of a portion of a patient's body located in the system, and processing the detected image.

DETAILED DESCRIPTION OF THE INVENTION

The present inventors have unexpectedly discovered that the eddy currents may be reduced or eliminated by placing at least one layer of a soft magnetic material between the permanent magnet and the portion of the yoke to which the permanent magnet is to be attached. This allows the imaging system, such as an MRI system, to be made without pole pieces. Thus, by omitting the pole pieces, the permanent magnet size, weight and cost may be significantly reduced compared to those of the prior art systems without a corresponding reduction in the strength of the magnetic field in the imaging volume. Alternatively, by omitting the pole pieces, the strength of the magnetic field in the imaging volume is significantly increased for a permanent magnet of a given size and weight compared to the same permanent magnet used in conjunction with pole pieces.

The present inventors have also realized that the manufacturing method of a permanent magnet may be simplified if the unmagnetized precursor alloy bodies are magnetized after they are attached to the support or the yoke of the imaging system. In a preferred aspect of the present invention, the permanent magnets precursor bodies are magnetized by providing a temporary coil around the unmagnetized precursor body and then applying a magnetic field to the precursor body from the coils to convert the precursor body into a permanent magnet body. Magnetizing the precursor alloy bodies after mounting greatly simplifies the mounting process and also increases the safety of the process because the unmagnetized bodies are not attracted to nearby iron objects. Therefore, there is no risk that the unattached bodies would become flying missiles aimed at nearby iron objects. Furthermore, the unattached, unmagnetized bodies do not stick in the wrong place on the iron yoke because they are unmagnetized. Thus, the use of the special robot and/or the crank may be avoided, decreasing the cost and increasing the simplicity of the manufacturing process.

I. The Preferred Magnet Assembly Composition

Figure 2:
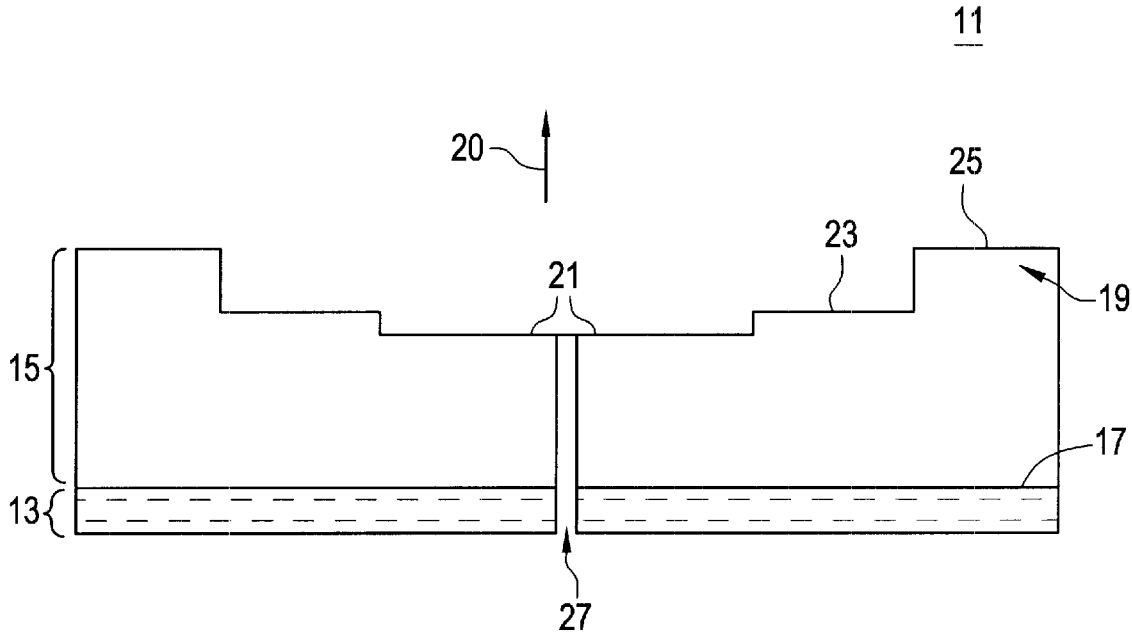
FIG. 2 is a side cross sectional view of a permanent magnet assembly according to the first preferred embodiment of the present invention.

FIG. 2 illustrates a side cross sectional view of a magnet assembly 11 for an imaging apparatus according to a first preferred embodiment of the present invention. The magnet assembly contains at least one layer of soft magnetic material 13 and a body of a first material 15 suitable for use as a permanent magnet. The body of the first material has a first surface 17 and a second surface 19. The first and the second surfaces are substantially parallel to the x-y plane, to which the direction of the magnetic field (i.e., the z-direction) is normal. The direction of the magnetic field (i.e., the z-axis direction) is schematically illustrated by the arrow 20 in FIG. 2. The first surface 17 is attached over the at least one layer of the soft magnetic material 13. The second or imaging surface 19 is adapted to face an imaging volume of the imaging apparatus.

In one preferred aspect of the present invention, the first material of the first body 15 comprises a magnetized permanent magnet material. The first material may comprise any permanent magnet material or alloy, such as CoSm, NdFe or RMB, where R comprises at least one rare earth element and M comprises at least one transition metal, for example Fe, Co, or Fe and Co.

In another preferred aspect of the present invention, the first material comprises an unmagnetized material suitable for use as a permanent magnet. In other words, the unmagnetized first material may be converted to a permanent magnet material by applying an anisotropic magnetic field of a predetermined magnitude to the first material. Thus, in this preferred aspect, the assembly 11 becomes a permanent magnet assembly after the first material is magnetized. The first material may comprise any unmagnetized material which may be converted to a permanent magnet material or alloy, such as CoSm, NdFe or RMB, where R comprises at least one rare earth element and M comprises at least one transition metal, for example Fe, Co, or Fe and Co.

Preferably, the first material comprises the RMB material, where R comprises at least one rare earth element and M comprises at least one transition metal, such as iron. Most preferred, the first material comprises a praseodymium (Pr) rich RMB alloy as disclosed in U.S. Pat. No. 6,120,620, incorporated herein by reference in its entirety. The praseodymium (Pr) rich RMB alloy comprises about 13 to about 19 atomic percent rare earth elements, where the rare earth content consists essentially of greater than 50 percent praseodymium, an effective amount of a light rare earth elements selected from the group consisting of cerium, lanthanum, yttrium and mixtures thereof, and balance neodymium; about 4 to about 20 atomic percent boron; and balance iron with or without impurities. As used herein, the phrase "praseodymium-rich" means that the rare earth content of the iron-boron-rare earth alloy contains greater than 50% praseodymium. In another preferred aspect of the invention, the percent praseodymium of the rare earth content is at least 70% and can be up to 100% depending on the effective amount of light rare earth elements present in the total rare earth content. An effective amount of a light rare earth elements is an amount present in the total rare earth content of the magnetized iron-boron-rare earth alloy that allows the magnetic properties to perform equal to or greater than 29 MGOe $(BH)_{max}$ and 6 kOe intrinsic coercivity (Hci). In addition to iron, M may comprise other elements, such as, but not limited to, titanium, nickel, bismuth, cobalt, vanadium, niobium, tantalum, chromium, molybdenum, tungsten, manganese, aluminum, germanium, tin, zirconium, hafnium, and mixtures thereof. Thus, the first material most preferably comprises 13–19 atomic percent R, 4–20 atomic percent B and the balance M, where R comprises 50 atomic percent or greater Pr, 0.1–10 atomic percent of at least one of Ce, Y and La, and the balance Nd.

The at least one layer of a soft magnetic material 13 may comprise one or more layers of any soft magnetic material. A soft magnetic material is a material which exhibits macroscopic ferromagnetism only in the presence of an applied external magnetic field. Preferably, the assembly 11 contains a laminate of a plurality of layers of soft magnetic material 13, such as 2–40 layers, preferably 10–20 layers. The possibility of the presence of plural layers is indicated by the dashed lines in FIG. 2. The individual layers are preferably laminated in a direction substantially parallel to the direction of the magnetic field emitted by the permanent magnet(s) of the assembly (i.e., the thickness of the soft magnetic layers is parallel to the magnetic field direction). However, if desired, the layers may be laminated in any other direction, such as at any angle extending from parallel to perpendicular to the magnetic field direction. The soft magnetic material may comprise any one or more of Fe—Si, Fe—Co, Fe—Ni, Fe—Al, Fe—Al—Si, Fe—Co—V, Fe—Cr—Ni and amorphous Fe- or Co-base alloys.

The magnet assembly 11 may have any shape or configuration. Preferably, the second surface 19 that is adapted to face an imaging volume of the imaging apparatus is shaped to optimize the shape, strength and uniformity of the magnetic field. The optimum shape of the body 15 and its second surface 19 is determined by a computer simulation, based on the size of the imaging volume, the strength of the magnetic field of the permanent magnet(s) and other design consideration. For example, the simulation may comprise a finite element analysis method. In a preferred aspect of the present invention, the second surface 19 has a circular cross section which contains a plurality of concentric rings 21, 23, 25 that extend to different heights respective to one another, as shown in FIG. 2. In other words, the surface 19 is stepped. Most preferably, the heights of the rings 21, 23, 25 decrease from the outermost ring 25 to the inner most ring 21. However, there may be two or more than three rings, and a height of any inner ring may be greater than a height of any outer ring, depending on the system configuration and the materials involved.

The assembly 11 also preferably contains a hole 27 which is adapted to receive a bolt which will attach the assembly 11 to a yoke of an imaging apparatus. However, the assembly 11 may be attached to the yoke by means other than a bolt, such as by glue and/or by brackets. The hole also provides for cooling of the gradient coils.

II. The Preferred Magnet Configuration

In a second preferred embodiment of the present invention, the body of the first material 15 (i.e., the unmagnetized alloy or the permanent magnet alloy) comprises at least two laminated sections. Preferably, these sections are laminated in a direction perpendicular to the direction of the magnetic field (i.e., the thickness of the sections is parallel to the magnetic field direction). Most preferably, each section is made of a plurality of square, hexagonal, trapezoidal, annular sector or other shaped blocks adhered together by an adhesive substance. An annular sector is a trapezoid that has a concave top or short side and a convex bottom or long side.

Figure 3:
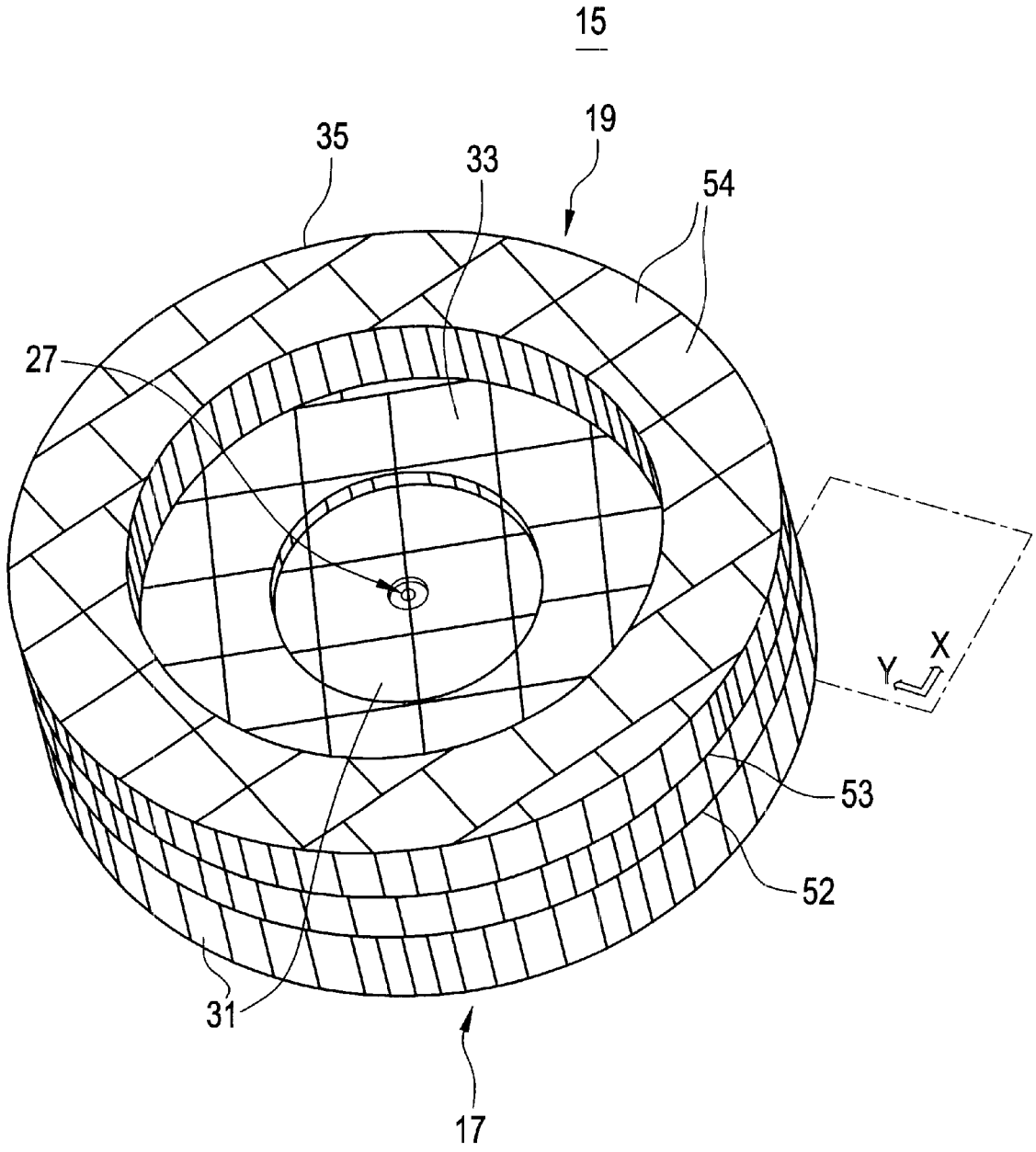
FIG. 3 is a perspective view of a body suitable for use as a permanent magnet according to the second preferred embodiment of the present invention.
Figure 4:
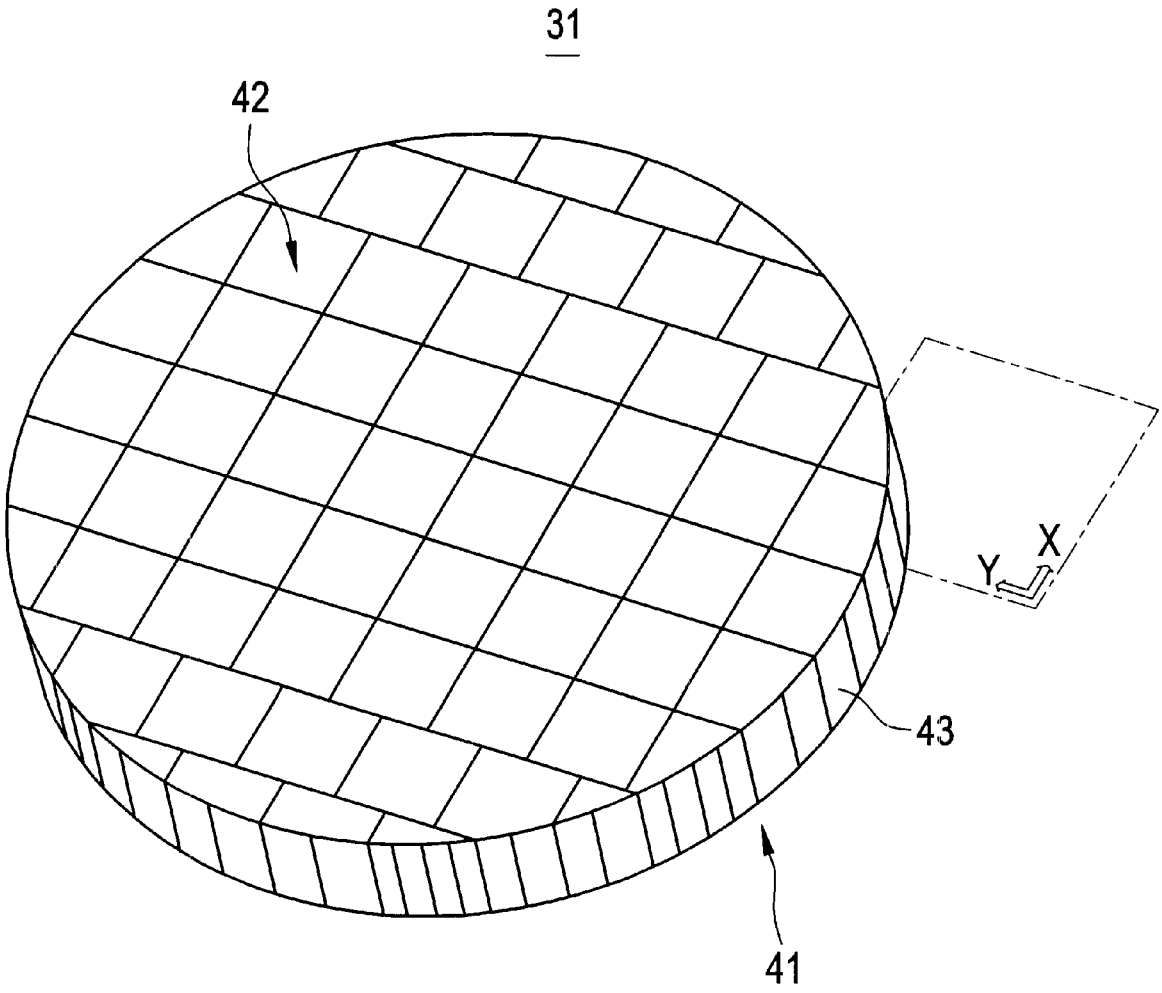
FIG. 4 is a perspective view of a base section of the body of FIG. 3.
Figure 5:
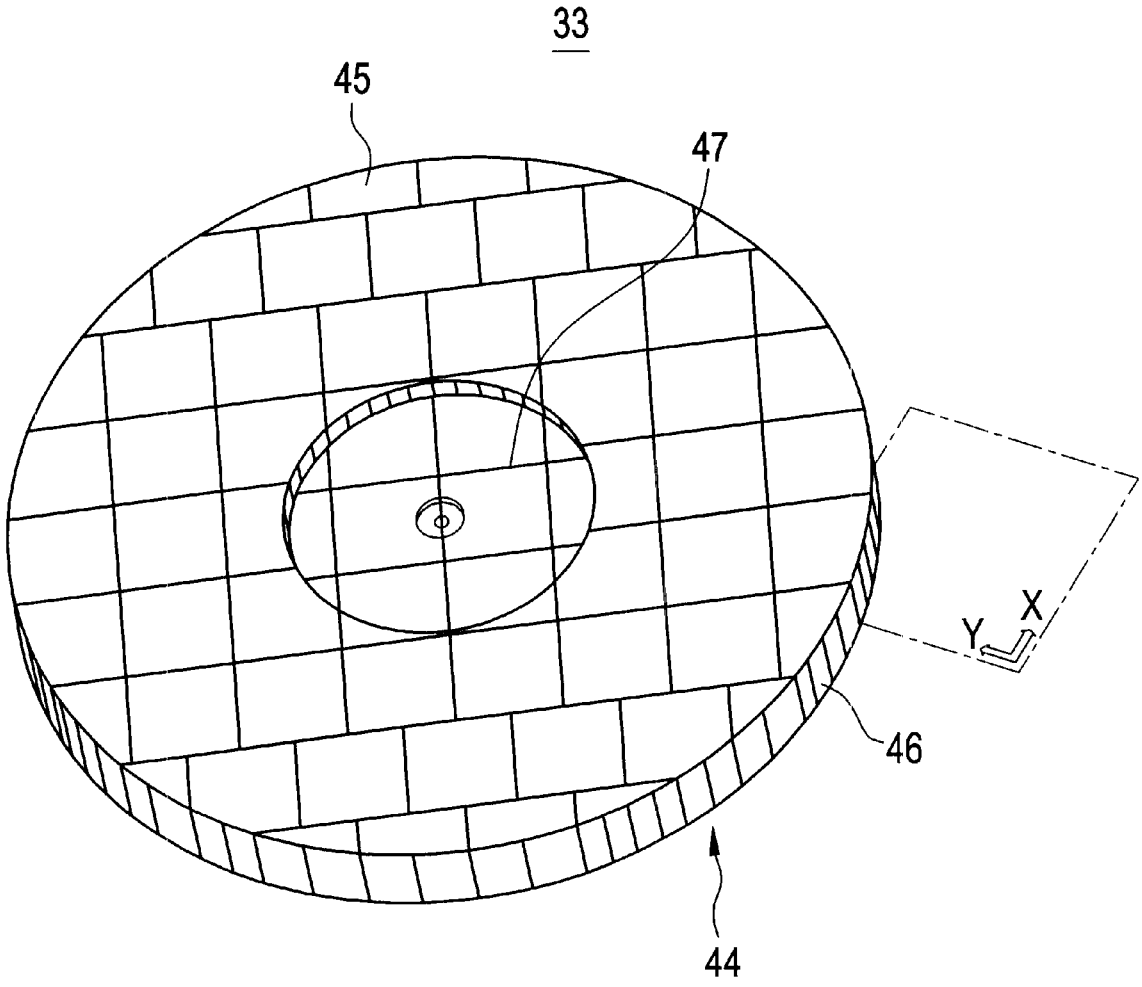
FIG. 5 is perspective view of an intermediate section of the body of FIG. 3.
Figure 6:
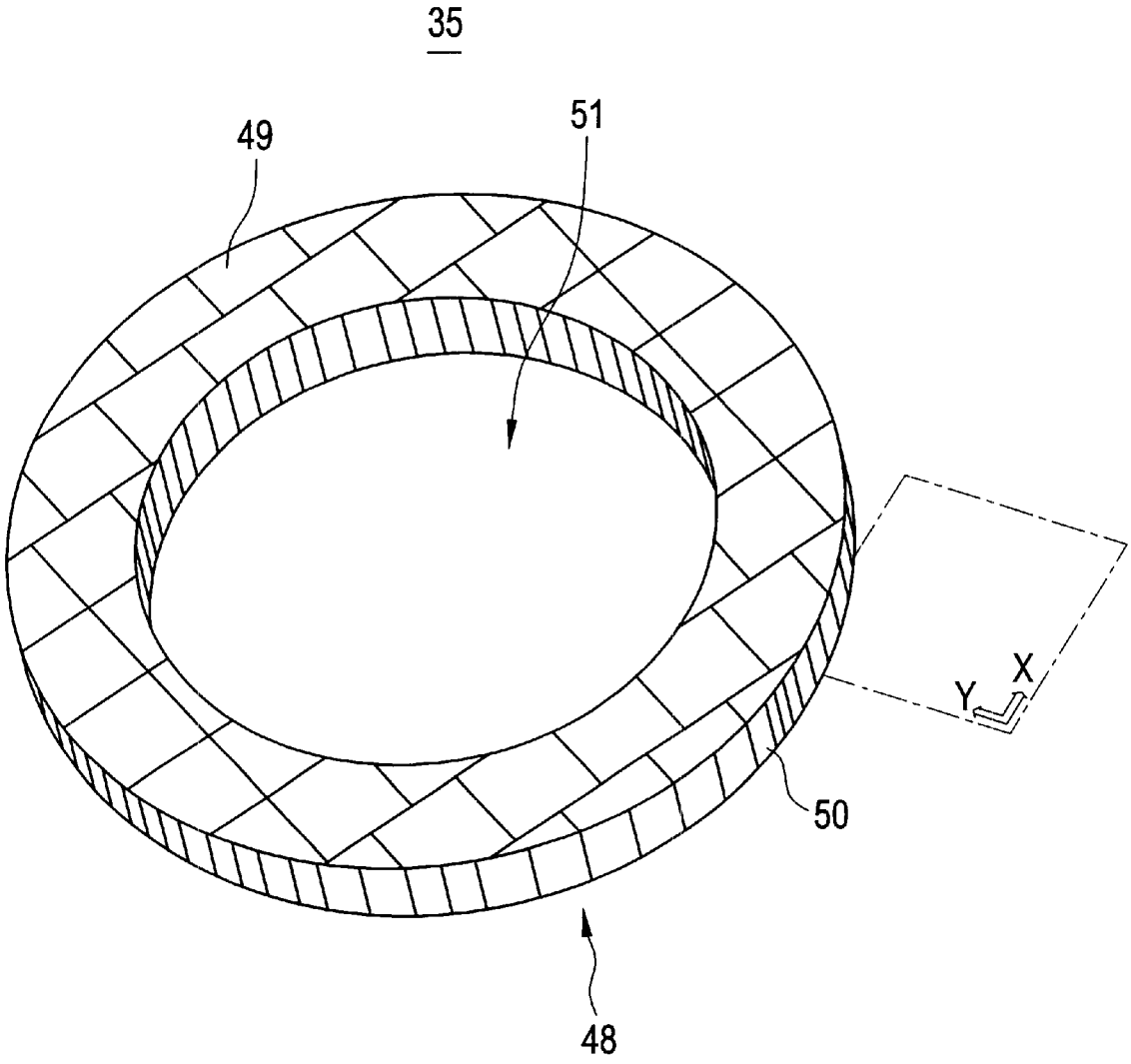
FIG. 6 is a perspective view of a hollow ring section of the body of FIG. 3.

One preferred configuration of the body 15 is shown in FIG. 3. The body 15 comprises a base section or body 31 suitable for use as a permanent magnet, as shown in FIG. 4, and a hollow ring section or body 35 suitable for use as a permanent magnet, as shown in FIG. 6. If desired, an optional intermediate section or body 33 suitable for use as a permanent magnet, as shown in FIG. 5, may be located between the base 31 and the hollow ring 35 bodies. However, the intermediate body 33 may be omitted and the hollow ring body 35 may be mounted directly onto the base body 31.

The base body 31 preferably has a cylindrical configuration, as shown in FIG. 4. The first 41 and second 42 major surfaces of the base body 31 are the "bottom" and "top" surfaces of the cylinder (i.e., the bases of the cylinder). The major surfaces 41, 42 have a larger diameter than the height of the edge surface 43 of the cylinder 31. Preferably, but not necessarily, the surfaces 41 and 42 are flat. The first surface 41 corresponds to the first surface 17 that is adapted to be attached to the at least one layer of soft magnetic material 13, as shown in FIG. 2.

The intermediate body 33 also preferably has a cylindrical configuration, with a first 44 and a second 45 major surfaces being base surfaces of the cylinder, as shown in FIG. 5. The major surfaces 44, 45 have a larger diameter than the height of the edge surface 46 of the cylinder 33. The first major surface 44 of the intermediate body 33 is attached to the second surface 42 of the base body 31. The second major surface 45 of the intermediate body contains a cylindrical cavity 47 extending partially through the thickness of the intermediate body 33.

The hollow ring body 35 also has a cylindrical configuration, with the first 48 and a second 49 major surfaces being base surfaces of the ring cylinder 35, as shown in FIG. 6. The major surfaces 48, 49 have a larger diameter than a height of the edge surface 50 of the ring body. The hollow ring body 35 has a circular opening 51 extending from the first 48 to the second 49 base surface, parallel to the direction of the magnetic field 20. The hollow ring body 35 is formed over the second major surface 45 of the intermediate body 33, such that the bottom of the cylindrical cavity 47 is exposed through the opening 51. The first major surface 48 of the body 35 is attached to the second surface 45 of the body 33.

The bodies 31, 33 and 35 may be attached to each other and to the soft magnetic material layer(s) 13 by any appropriate means, such as adhesive layers, brackets and/or bolt (s). Preferably, a first layer 52 of adhesive substance, such as epoxy or glue is provided between the second surface 42 of the base body 31 and the first surface 44 of the intermediate body 33. A second layer 53 of adhesive substance, such as an epoxy or glue, is provided between the second surface 45 of the intermediate body and the first surface 48 of the hollow ring body 35. The exposed portions of surfaces 42, 45 and 49 of the body 15 shown in FIGS. 3–6 correspond to the imaging surface 19 shown in FIG. 2.

Preferably, the cylindrical base body 31, the cylindrical intermediate body 33 and the hollow ring body 35 comprise a plurality of square, hexagonal, trapezoidal or annular sector shaped blocks 54 of permanent magnet or unmagnetized material adhered together by an adhesive substance, such as epoxy. However, the bodies 31, 33 and 35 may comprise unitary bodies instead of being made up of individual blocks.

Figure 1:
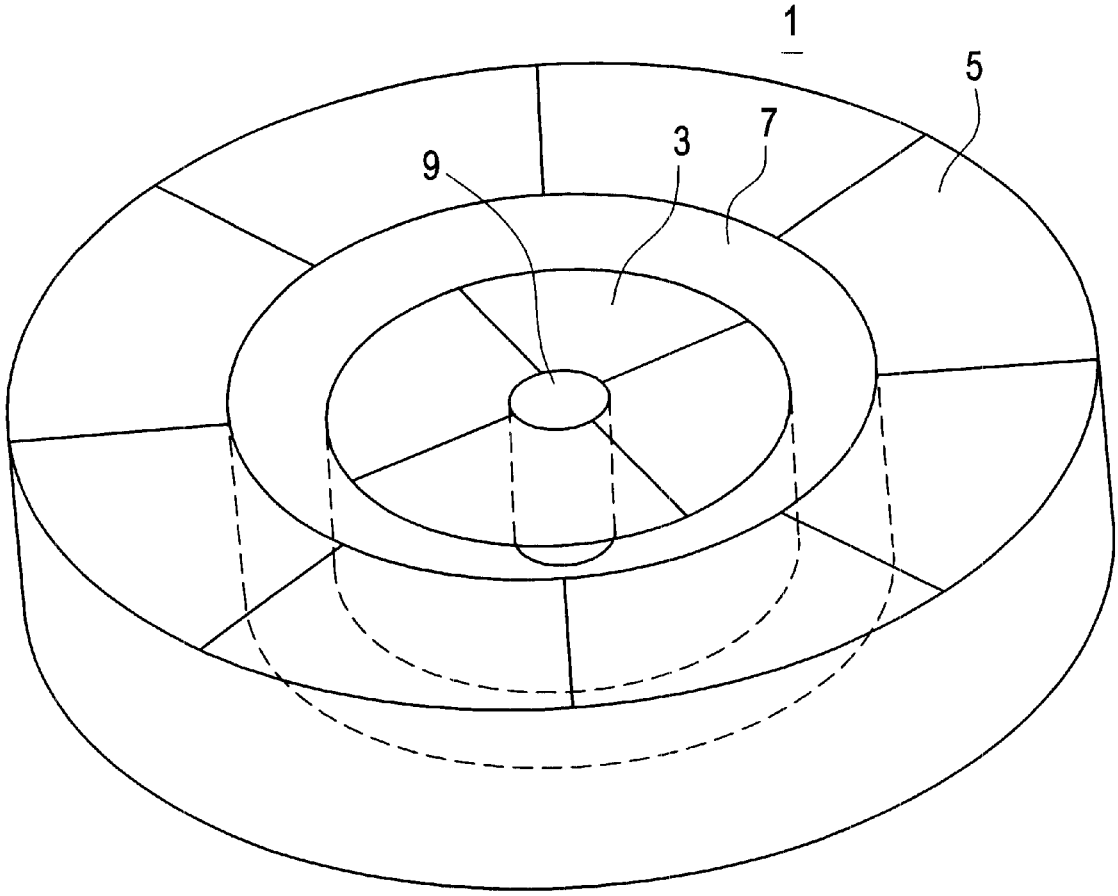
FIG. 1 PRIOR ART
FIG. 1 is a perspective view of a prior art magnet assembly.

Thus, in contrast to the prior art magnet assembly configuration shown in FIG. 1, the major surfaces of the cylindrical bodies 31, 33, 35 that are arranged perpendicular to the direction of the magnetic field 20 (i.e., the surfaces in the x-y plane) are attached to each other and overlap each other. Therefore, there is no requirement for non-magnetic spacers, as in the prior art assembly of FIG. 1. In contrast, the bodies 3, 5 of the prior art assembly 1 of FIG. 1 are connected at the edge surfaces (i.e., the surfaces that are parallel to the magnetic field direction) of the bodies. The surfaces of the cylindrical bodies 3, 5 located in the x-y plane shown in FIG. 1 do not overlap each other. Furthermore, in contrast to the prior art assembly of FIG. 1, there are no gaps that extend all the way through the thickness of the body 15 in the direction parallel to the magnetic field direction 20 in the preferred configuration of the second preferred embodiment. Such configuration improves the properties of the magnetic field.

III. The Preferred Imaging System

The magnet assembly 11 of the preferred embodiments of the present invention is preferably used in an imaging system, such as an MRI, MRT or an NMR system. Most preferably, at least two magnet assemblies of the preferred embodiments are used in an MRI system. The magnet assemblies are attached to a yoke or a support in an MRI system.

Figure 7:
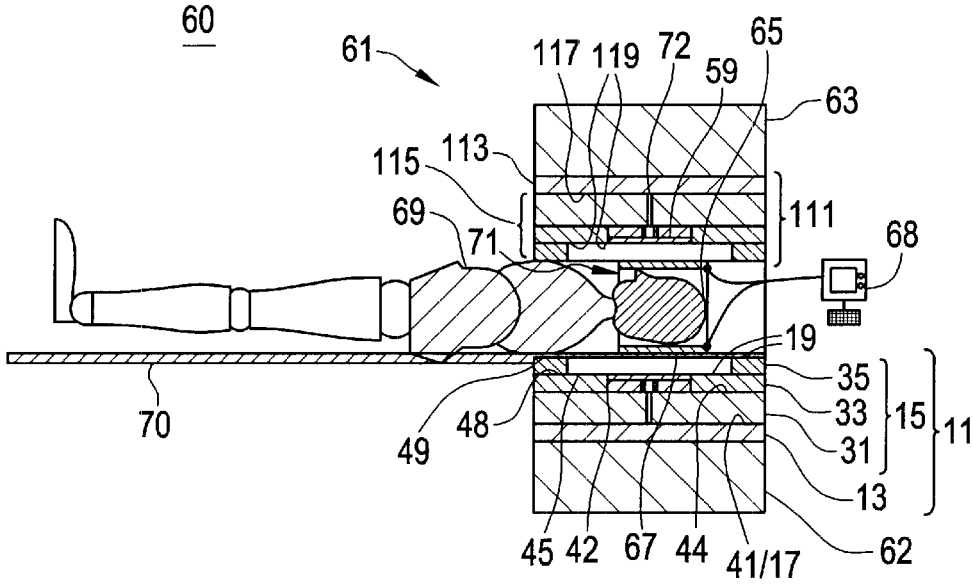
FIG. 7 is a side cross sectional view of an MRI system containing a. permanent magnet assembly according the preferred embodiments of the present invention.

Any appropriately shaped yoke may be used to support the magnet assemblies. For example, a yoke generally contains a first portion, a second portion and at least one third portion connecting the first and the second portion, such that an imaging volume is formed between the first and the second portion. FIG. 7 illustrates a side cross sectional view of an MRI system 60 according to one preferred aspect of the present invention. The system contains a yoke 61 having a bottom portion or plate 62 which supports the first magnet assembly 11 and a top portion or plate 63 which supports the second magnet assembly 111. It should be understood that "top" and "bottom" are relative terms, since the MRI system 60 may be turned on its side, such that the yoke contains left and right portions rather than top and bottom portions. The imaging volume is 65 is located between the magnet assemblies.

As described above, the first magnet assembly 11 comprises at least one permanent magnet body 15 containing an imaging (i.e., second) surface 19 exposed to the imaging volume 65 and at least one soft magnetic material layer 13 between a back (i.e., first) surface 17 of the at least one permanent magnet 15 and the first yoke portion 62. The second magnet assembly 111 is preferably identical to the first assembly 11. The second magnet assembly 111 comprises at least one permanent magnet body 115 containing an imaging (i.e., second) surface 119 exposed to the imaging volume 65 and at least one soft magnetic material layer 113 between a back (i.e., first) surface 117 of the at least one permanent magnet 115 and the second yoke portion 63.

The MRI system 60 is preferably operated without pole pieces formed between the imaging surfaces 19, 119 of the permanent magnets 15, 115 of the first 11 and second 111 magnet assemblies and the imaging volume 65. However, if desired, very thin pole pieces may be added to further reduce or eliminate the occurrence of eddy currents. The MRI system further contains conventional electronic components, such as a gradient coil 59, an rf coil 67 and an image processor 68, such as a computer, which converts the data/signal from the rf coil 67 into an image and optionally stores, transmits and/or displays the image. These elements are schematically illustrated in FIG. 7.

FIG. 7 further illustrates various optional features of the MRI system 60. For example, the system 60 may optionally contain a bed or a patient support 70 on which supports the patient 69 whose body is being imaged. The system 60 may also optionally contain a restraint 71 which rigidly holds a portion of the patient's body, such as a head, arm or leg, to prevent the patient 69 from moving the body part being imaged. In FIG. 7, the magnet assemblies 11, 111 are attached to the yoke 61 by bolts 72. However, the magnet assemblies may be attached by other means, such as by brackets and/or by glue.

The system 60 may have any desired dimensions. The dimensions of each portion of the system are selected based on the desired magnetic field strength, the type of materials used in constructing the yoke 61 and the assemblies 11, 111 and other design factors.

Figure 8:
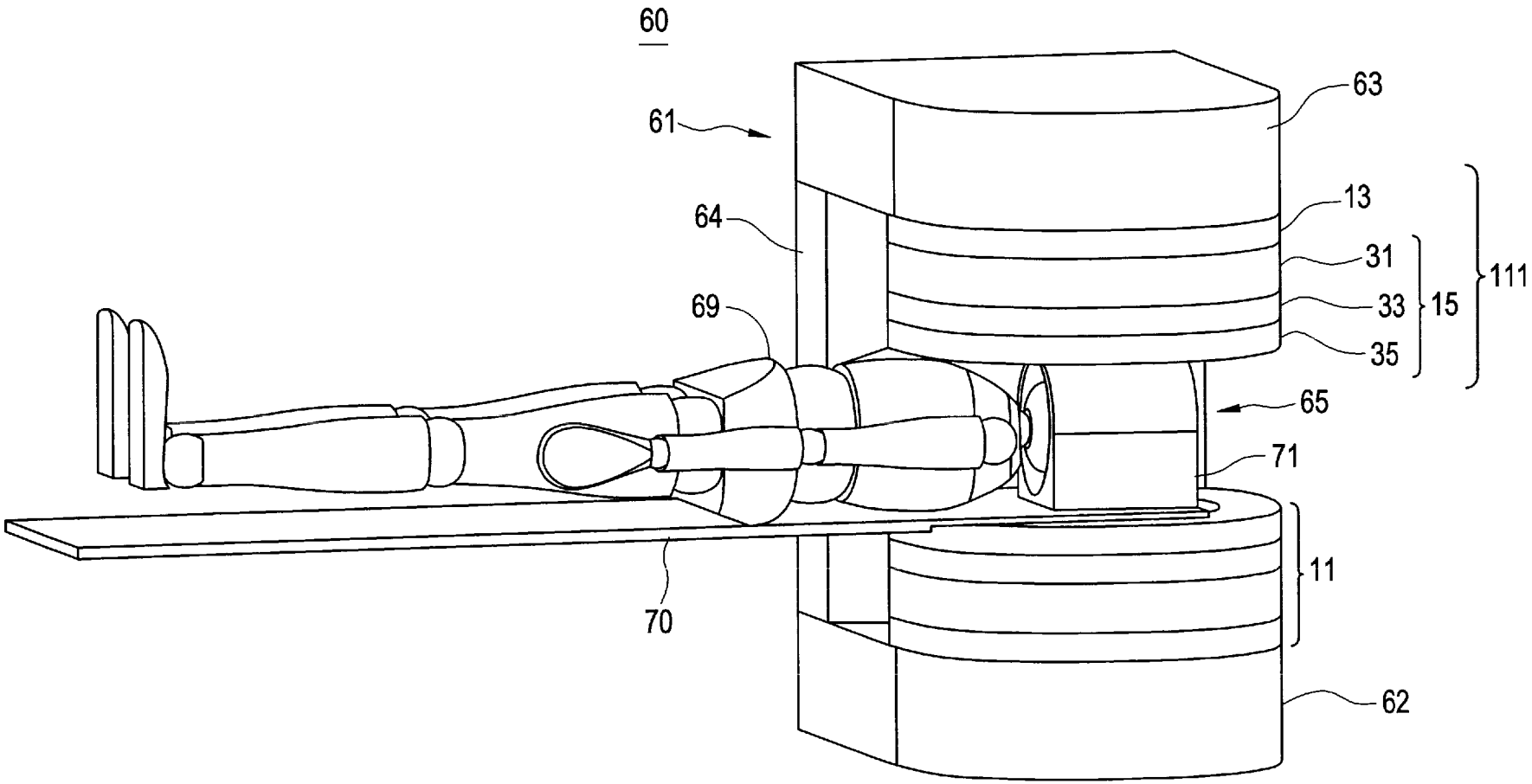
FIG. 8 is a perspective view of an MRI system containing a "C" shaped yoke.

In one preferred aspect of the present invention, the MRI system 60 contains only one third portion 64 connecting the first 62 and the second 63 portions of the yoke 61. For example, the yoke 61 may have a "C" shaped configuration, as shown in FIG. 8. The "C" shaped yoke 61 has one straight or curved connecting bar or column 64 which connects the bottom 62 and top yoke 63 portions.

Figure 9:
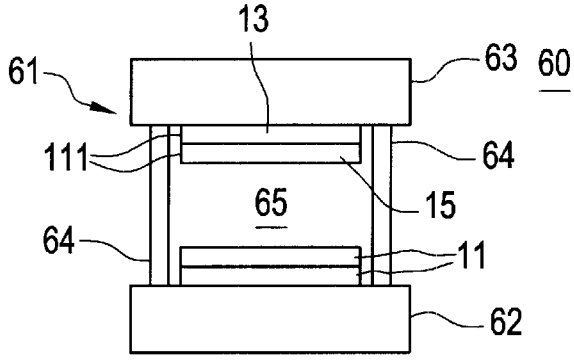
FIG. 9 is a side cross sectional view of an MRI system containing a yoke having a plurality of connecting bars.

In another preferred aspect of the present invention, the MRI system 60 has a different yoke 61 configuration, which contains a plurality of connecting bars or columns 64, as shown in FIG. 9. For example, two, three, four or more connecting bars or columns 64 may connect the yoke portions 62 and 63 which support the magnet assemblies 11, 111.

Figure 10:
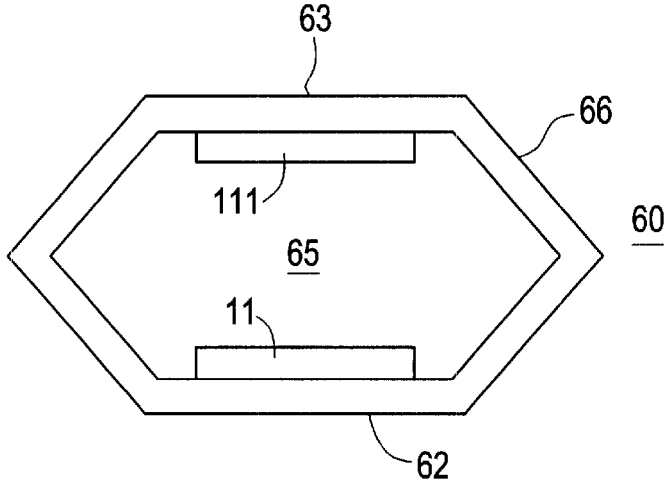
FIG. 10 is a side cross sectional view of an MRI system containing a tubular yoke.

In yet another preferred aspect of the present invention, the yoke 61 comprises a unitary tubular body 66 having a circular or polygonal cross section, such as a hexagonal cross section, as shown in FIG. 10. The first magnet assembly 11 is attached to a first portion 62 of the inner wall of the tubular body 66, while the second magnet assembly 111 is attached to the opposite portion 63 of the inner wall of the tubular body 66 of the yoke 61. If desired, there may be more than two magnet assemblies in attached to the yoke 61. The imaging volume 65 is located in the hollow central portion of the tubular body 66.

The imaging apparatus, such as the MRI 60 containing the permanent magnet assembly 11, is then used to image a portion of a patient's body using magnetic resonance imaging. A patient 69 enters the imaging volume 65 of the MRI system 60, as shown in FIGS. 7 and 8. A signal from a portion of a patient's 69 body located in the volume 65 is detected by the rf coil 67, and the detected signal is processed by using the processor 68, such as a computer. The processing includes converting the data/signal from the rf coil 67 into an image, and optionally storing, transmitting and/or displaying the image.

IV. The Preferred Method of Making the Imaging System

In a third preferred embodiment of the present invention, a precursor body comprising a first unmagnetized material is attached to the support or yoke of the imaging apparatus prior to magnetizing the first unmagnetized material to form a first permanent magnet body. It is preferred to form the permanent magnet body according to the first and second preferred embodiments described above by magnetizing the unmagnetized precursor body prior to attaching this body to the imaging apparatus support. However, the permanent magnet body according to the first and second preferred embodiments may be magnetized before being attached to the support or yoke, if desired.

Furthermore, it should be noted that the third preferred embodiment is not limited to forming an imaging apparatus which contains a soft magnetic material between the yoke and the permanent magnet or which has a magnet assembly having a configuration illustrated in FIGS. 2 and 3. The method of the third preferred embodiment may be used to form an imaging apparatus having any magnet assembly composition and configuration. Furthermore, the method of the third preferred embodiment is not necessarily limited to forming an imaging apparatus. The precursor body may be attached to a support prior to magnetization in any device which uses a permanent magnet, such as transformers and other heavy current devices.

According to the third preferred embodiment, a method of making an imaging device, such as an MRI, MRT or NMR system, includes providing a support, attaching a first precursor body comprising a first unmagnetized material to the first support portion and magnetizing the first unmagnetized material to form a first permanent magnet body after attaching the first precursor body. Preferably, a second precursor body comprising a the same or different unmagnetized material as the first material is attached to the second support portion and magnetized to form a second permanent magnet body after attaching the second precursor body.

The support preferably contains first portion, a second portion and at least one third portion connecting the first and the second portion such that an imaging volume is formed between the first and the second portions. For example, the support may comprise the yoke 61 of FIGS. 7, 8, 9 or 10 of the MRI system 60. The first and second precursor bodies may comprise any unmagnetized material that is suitable for use as a permanent magnet. Preferably the precursor bodies comprise an assembly of plurality of blocks of an RMB alloy, where R comprises at least one rare earth element and M comprises at least one transition metal, for example Fe, Co, or Fe and Co, such as an alloy which most preferably comprises 13–19 atomic percent R, 4–20 atomic percent B and the balance M, where R comprises 50 aromic percent or greater Pr, 0.1–10 atomic percent of at least one of Ce, Y and La, and the balance Nd.

Most preferably, the method of the third preferred embodiment further comprises attaching at least one layer of soft magnetic material layer between the first and second precursor bodies of the unmagnetized material and the respective support portion of the yoke prior to magnetizing the unmagnetized material of the precursor bodies. As described in connection with the first preferred embodiment, the at least one layer of a soft magnetic material preferably comprises a laminate of Fe—Si, Fe—Al, Fe—Co, Fe—Ni, Fe—Al—Si, Fe—Co—V, Fe—Cr—Ni, or amorphous Fe- or Co-base alloy layers. The laminate of soft magnetic material layers may be attached to the yoke prior to attaching the precursor bodies or a laminate may be first attached to each precursor body, and subsequently both the laminates and the precursor bodies may be attached to the yoke.

The unmagnetized material of the precursor body may be magnetized by any desired magnetization method after the precursor body or bodies is/are attached to the yoke or support. For example, the preferred step of magnetizing the first precursor body comprises placing a coil around the first precursor body, applying a pulsed magnetic field to the first precursor body to convert the unmagnetized material of the first precursor body into at least one first permanent magnet body, and removing the coil from the first permanent magnet body. Likewise, the step of magnetizing the second precursor body, if such a body is present, comprises placing a coil around the second precursor body, applying a pulsed magnetic field to the second precursor body to convert the at least one unmagnetized material of the second precursor body to at least one permanent magnet body, and removing the coil from around the second permanent magnet body.

The same or different coils may be used to magnetize the first and second precursor bodies. For example, a first coil may be placed around the first precursor body and a second coil may be placed around the second precursor body. A pulsed current or voltage is applied to the coils simultaneously or sequentially to apply a pulsed magnetic field to the first and second precursor bodies. Alternatively, only one coil may be used to sequentially magnetize the first and second precursor bodies. The coil is first placed around the first precursor body and a magnetic field is applied to magnetize the first precursor body. Thereafter, the same coil is placed around the second precursor body and a magnetic field is applied to magnetize the second precursor body.

Figure 11:
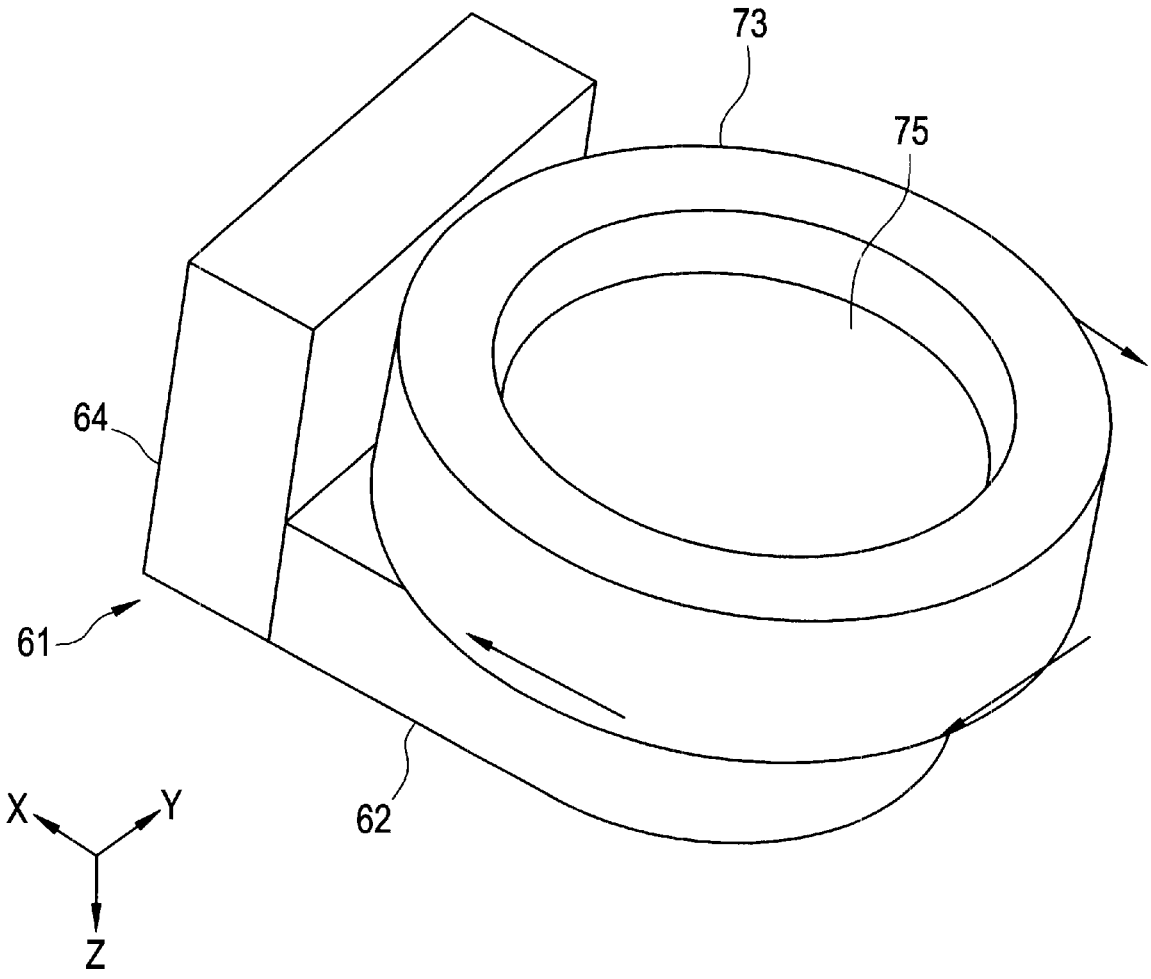
FIG. 11 is a perspective view of a coil housing used to magnetize an unmagnetized material suitable for use as a permanent magnet.

Preferably, the coil that is placed around the precursor body is provided in a housing 73 that fits snugly around the precursor body 75 located on a portion 62 of the yoke 61, as shown in FIG. 11. For example, for a precursor body 75 having a cylindrical outer configuration, such as the body 15 shown in FIG. 3, the housing 73 comprises a hollow ring whose inner diameter is slightly larger than the outer diameter of the precursor body 75. The coil is located inside the walls of the housing 75.

Preferably, a cooling system is also provided in the housing 73 to improve the magnetization process. For example, the cooling system may comprise one or more a liquid nitrogen flow channels inside the walls of the housing 73. The liquid nitrogen is provided through the housing 73 during the magnetization step. Preferably, a magnetic field above 2.5 Tesla, most preferably above 3.0 Tesla, is provided by the coil to magnetize the unmagnetized material, such as the RMB alloy, of the precursor body or bodies.

V. The Preferred Methods of Making the Magnet Assembly

The methods of making the precursor body of unmagnetized material according to the fourth and fifth preferred embodiment will now be described. While a method of making the body 15 having a configuration illustrated in FIG. 3 will be described for convenience, it should be understood that the precursor body 15 may have any desired configuration and may be made by any desired method.

Figure 12:
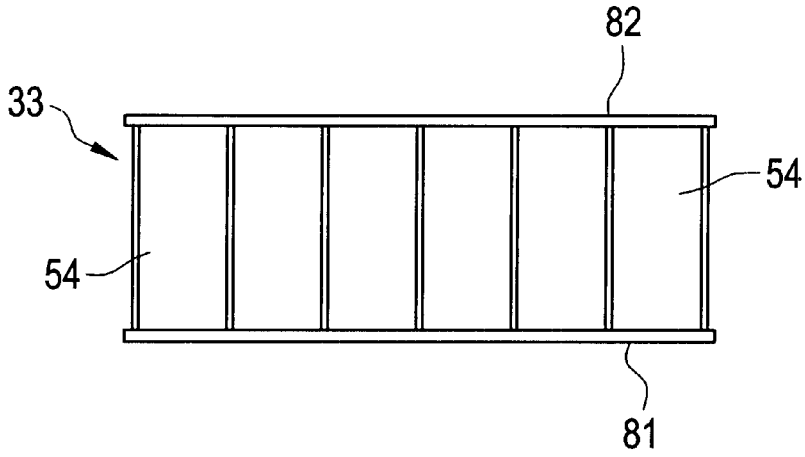
FIGS. 12–14 are side cross sectional views of a method of making a body of material suitable for use as a permanent magnet.

According to the method of the fourth preferred embodiment, a plurality of blocks 54 of unmagnetized material are placed on a support 81, as shown in FIG. 12. Preferably, the support 81 comprises a non-magnetic metal sheet or tray, such as a flat, 1/16 inch aluminum sheet coated with a temporary adhesive. However, any other support may be used. A cover 82, such as a second aluminum sheet covered with a temporary adhesive is placed over the blocks 54.

Figure 13:
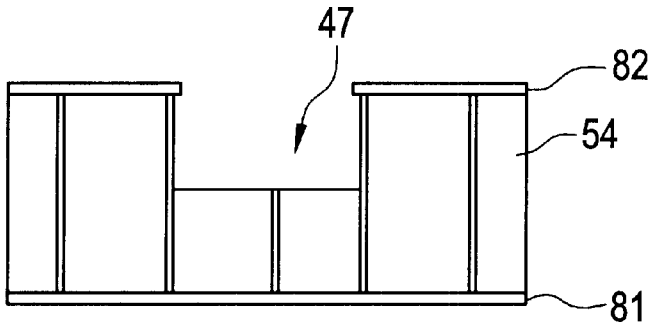

The blocks 54 are then shaped to form a first precursor body prior to removing the cover 82 and the support 81, as shown in FIG. 13. For example, the first precursor body may comprise the base body 31, the intermediate body 33 or the hollow ring body 35, as shown in FIGS. 3–6. The blocks may be shaped by any desired method, such as by a water jet. For example, the water jet cuts the rectangular assembly of blocks 54 into a cylindrical or ring shaped body 31, 33 or 35 (body 33 is shown in FIG. 13 for example). Preferably, the water jet cuts through the support 81 and cover 82 sheets during the shaping of the assembly of the blocks 54.

Figure 14:
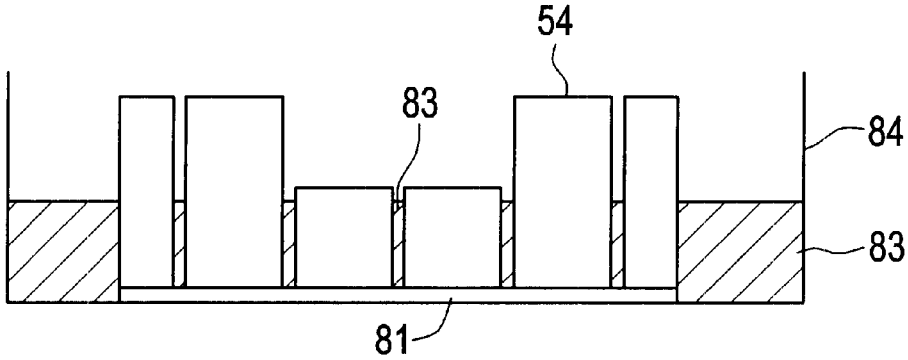

The cover sheet 82 is then removed and an adhesive material 83 is then provided to adhere the blocks 54 to each other, as shown in FIG. 14. For example, the shaped blocks 54 attached to the support sheet 81 are placed into an epoxy pan 84, and an epoxy 83, such as Resinfusion 8607 epoxy, is provided into the gaps between the blocks 54. If desired, sand, chopped glass or other filler materials may also be provided into the gaps between blocks 54 to strengthen the bond between the blocks 54 of the precursor body 31, 33 or 35. Preferably, the epoxy 83 is poured to a level below the tops of the blocks 54 to allow the precursor body 31, 33 or 35 to be attached to another precursor body. The support sheet 81 is then removed from the shaped precursor body 31, 33 or 35. Alternatively, while less preferred, the precursor bodies 31, 33, 35 may be shaped, such as by a water jet, into a larger body 15 of the desired shape, such as a cylindrical body, after being bound with epoxy 83.

Furthermore, if desired, release sheets may be attached to the exposed inside and outside surfaces of the bodies 31, 33 and/or 35 prior to pouring the epoxy 83. The release sheets are removed after pouring the epoxy 83 to expose bare surfaces of the blocks 54 of the bodies 31, 33 and/or 35 to allow each body to be adhered to another body. If desired, a glass/epoxy composite may be optionally would around the outside diameters of the bodies to 2–4 mm, preferably 3 mm for enhanced protection.

After the bodies 31, 33 and 35 shown in FIG. 4–6 are formed, they are attached to each other as shown in FIG. 3 by providing a layer of adhesive between bodies 31 and 33 and between bodies 33 and 35. The adhesive layer may comprise epoxy with sand and/or glass or CA superglue. For example, a first layer of adhesive material 52 is provided over a second base surface 42 of the base body 31. The cylindrical intermediate precursor body 33 is attached over the first layer of adhesive material 52, such that an exposed base surface 45 of the intermediate precursor body contains a cylindrical cavity 47 extending partially through the thickness of the intermediate precursor body 33. A second layer of adhesive material 53 is provided over a periphery of the exposed surface 45 of the intermediate precursor body 33. The hollow ring precursor body 35 is then attached to the second layer of adhesive material 53 to form the structure of FIG. 3. Preferably, the bodies 31, 33 and 35 are rotated 15 to 45 degrees, most preferably about 30 degrees with respect to each other, to interrupt continuous epoxy filled channels from propagating throughout the entire structure.

Figure 15:
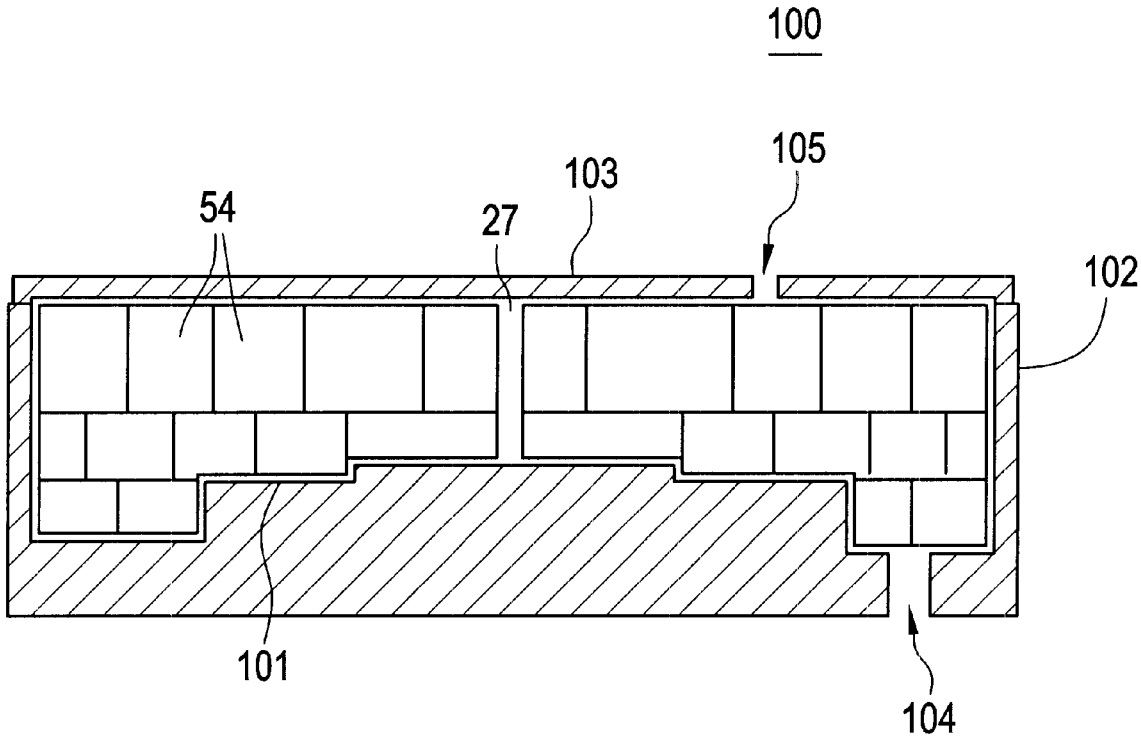
FIG. 15 is a side cross sectional view of a mold used to join together blocks into a unitary body.

According to a fifth preferred embodiment of the present invention, the precursor bodies are fabricated using a shaped mold 100, as shown in FIG. 15. The mold 100 contains a bottom surface 101, a side surface 102 and a cover plate 103. The mold further contains one or more epoxy inlet openings 104 and one or more air outlet openings 105. The opening(s) 104 is preferably made in the bottom mold surface 101 and the opening(s) 105 is preferably made in the cover plate 103.

The mold preferably contains a non-uniform cavity surface contour. Preferably, the non-uniform contour is established by an irregularly shaped bottom surface 101 form a non-uniform contour comprising protrusions and recesses. Alternatively, the contour may be established by attaching spacers of various heights to the mold cavity bottom surface 101.

As shown in FIG. 15, the bottom surface 101 in different portions of the mold has a different height or thickness. The bottom surface 101 in the mold 100 forms a substantially inverse contour of the imaging surface 19 of the precursor body 15. "Substantially inverse" means that the mold surface contour may differ from the precursor body contour. For example, there may be gaps between in the surface that are not present in the precursor body contour. Furthermore, there may be other slight vertical and horizontal variations in the contours.

A method of making the precursor body 15 according to the fifth embodiment present invention first comprises coating the mold cavity with a release agent. Individual blocks 54 are then placed into the mold cavity. The blocks 54 may be pre-cut to the desired shape to form the desired precursor body. For example, the blocks 54 may have a trapezoidal or annular sector shape and be arranged in concentric annular arrays in the mold cavity to form a cylindrical precursor body 15. When trapezoidal or annular sector shaped blocks are used, the major surfaces of a cylindrical unitary body forms a plurality of stepped concentric rings. Alternatively, square or rectangular blocks 54 that comprise an edge of a cylindrical body may be precut to form a portion of a round outer perimeter of such body.

The blocks 54 are stacked on the bottom surface 101 of the mold 100. The heights of the blocks 54 should extend to the height of the mold cavity, such that the top surface of the blocks is substantially level with the top of the mold cavity. All variations as a result of block height tolerances are taken as a small gap near the top of the mold cover plate 103.

The mold is then covered with the cover plate 103 and an adhesive substance, is introduced into the mold 100 through the inlet opening 104. Alternatively, the adhesive substance may be introduced through the top opening 105 or through both top and bottom openings. The adhesive substance is preferably a synthetic epoxy resin. The epoxy does not become attached to the mold cavity because it is coated with the release agent. The epoxy permeates between the individual blocks 54 and forces out any air trapped in the mold through outlet opening(s) 105. The epoxy binds the individual blocks into a unitary precursor body 15. Alternatively, while less preferred, the body 15 may be further shaped, such as by a water jet, into a desired shape, such as a cylindrical body, after being bound with epoxy in the mold.

The mold cover plate 103 is taken off the mold and the unitary precursor body 15 is removed from the mold 100. The unitary precursor body 15 is then attached with its flat (top) side to the yoke 61 of an imaging apparatus, such as the MRI 60.

The precursor body 15 may have any desired configuration. For example, the entire precursor body 15 illustrated in FIG. 3 may simultaneously assembled in the mold 100 by stacking the respective blocks 54 into the mold cavity. In a preferred aspect of the fifth embodiment, the base 31, the intermediate 33 and the hollow ring 35 precursor bodies illustrated in FIGS. 4–6 are assembled sequentially in the mold 100. The bodies 31, 33, 35 may then be adhered together after being individually formed in the mold 100.

THE SPECIFIC EXAMPLES

Example 1

A MRI system for imaging the whole body of a patient has been designed. The MRI system has a magnetic field strength of 0.35 Tesla. The permanent magnet assemblies were attached to a "C" shaped iron yoke. The permanent magnet assemblies include about a 5 cm thick laminate of amorphous iron soft magnetic layers between praseodymium rich RFeB permanent magnet bodies and the respective portions of the yoke. The magnet bodies include two solid disks and one ring, as shown in FIG. 3. One disk is about 5 cm thick, the other disk is about 7 cm thick and the outside ring is about 10 cm thick. The two magnet bodies together weighed 4600 lb. The diameter of the permanent magnet assemblies was 114 cm. The total weight of the iron in the MRI, including the yoke, was 18,100 lb., for a total magnet assembly/yoke weight of 22,700 lb. The permanent magnet assemblies were passively shimmed, but no pole pieces or gradient coils were used. The MRI contained a 46 cm horizontal patient gap. The total thickness of the top portion of the yoke and the magnet assembly was 120 cm. The SG line from center (R×Z) was 1.5×1.5 meters. The uniformity of the magnetic field for a particular imaging volume was computed and the results are presented in Table 1, below.

TABLE 1

| Imaging volume (field of view) | Field uniformity in parts per million of Tesla |
|---|---|
| Sphere having a 15 cm diameter | 0.5 |
| Sphere having a 20 cm diameter | 5 |
| Sphere having a 35 cm diameter | 16 |
| Parallelepiped having 42 × 35 dimensions | 19.5 |

Thus, a uniformity of at least 0.5 ppm may be obtained for a spherical imaging volume having a diameter of 15 cm, a uniformity of at least 5 ppm may be obtained for a spherical imaging volume having a diameter of 20 cm and a uniformity of at least 16 ppm may be obtained for a spherical imaging volume having a diameter of 35 cm.

Comparative Example 2

A prior art MRI system containing a pair of NdFeB permanent magnets attached to top and bottom portions of "C" shaped yoke is provided. Pole pieces were attached to the imaging surface of the permanent magnets (i.e., between the imaging volume and the magnets). This MRI system has a magnetic field strength of 0.35 Tesla and a 46 cm horizontal patient gap. The imaging volume is a 42×35 cm parallelepiped having a field uniformity of 20 ppm. The weight of the pair of permanent magnets is 7,100 lb. and the total weight of the iron, including the yoke, is 35,200 lb. for a total magnet/yoke weight of 42,300. No soft magnetic material is provided between the magnets and the yoke.

Comparison of Examples 1 and 2

The same magnetic field strength with substantially the magnetic field uniformity (within 5%) is obtained by the MRI of Example 1 compared to the prior art MRI of comparative Example 2. However, the permanent magnets of the MRI of Example 1 weigh 2,500 lb. less than the permanent magnets of the MRI of comparative Example 2, for a considerable cost saving. Furthermore, significantly less iron is required in the MRI of Example 1 compared to the MRI of comparative Example 2. Thus, the MRI of Example 1 is lighter, easier to move, and cheaper and easier to manufacture than the MRI of comparative Example 2.

Thus, an MRI system with a permanent magnet bodies that weigh at least 20% less, preferably at least 35% less, even up to 65 to 75% less, may be used to generate a magnetic field having the same strength and substantially the same uniformity as the prior art MRI system by omitting the pole pieces and by providing at least one layer of soft magnetic material between the yoke and the permanent magnets. Furthermore, an MRI system that weighs at least 45% less than a comparable prior art MRI system may be obtained by omitting the pole pieces and by providing at least one layer of soft magnetic material between the yoke and the permanent magnets.

Figure 16:
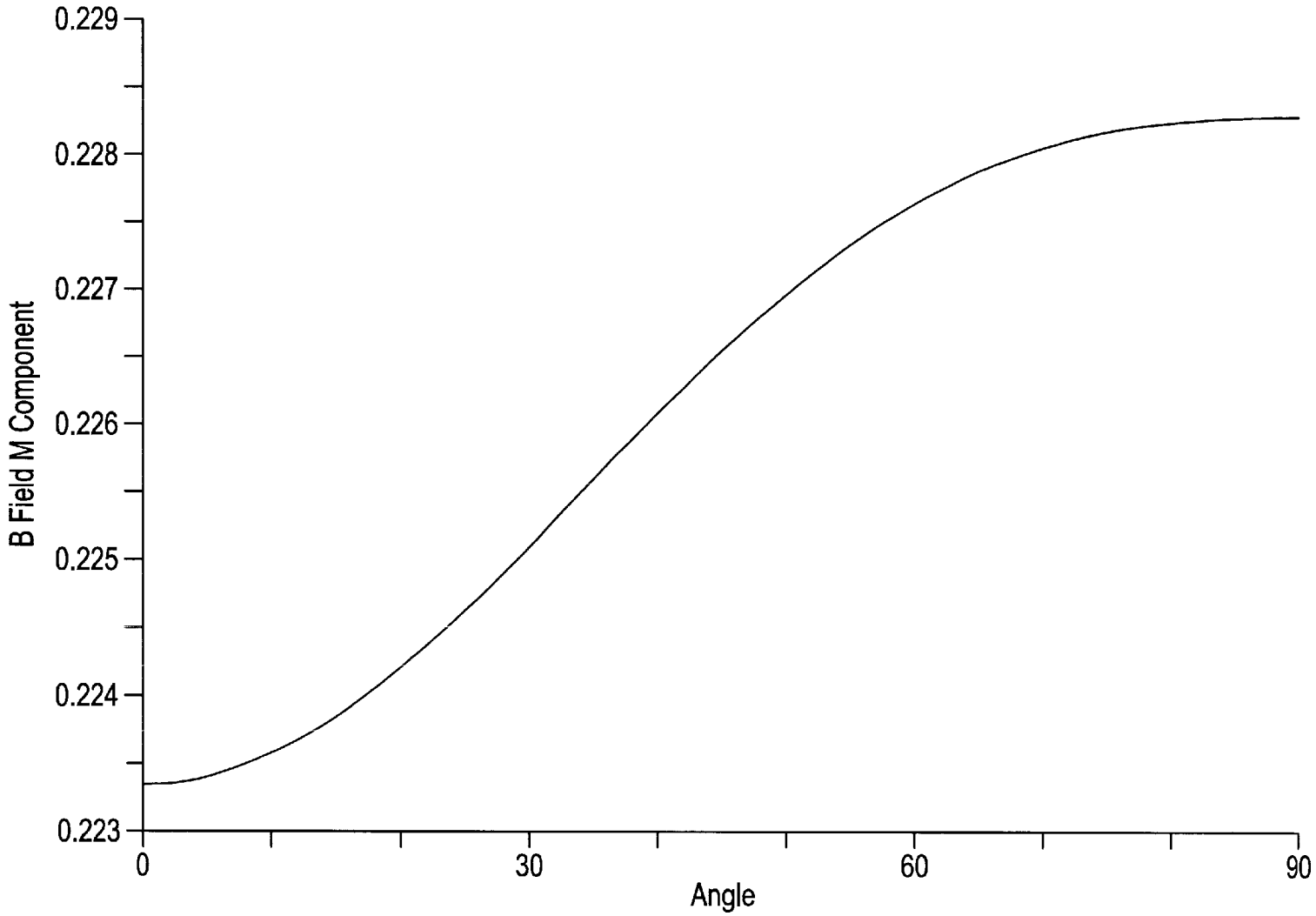
FIG. 16 is a plot of magnetic field versus position angle in an MRI system according to a preferred embodiment of the present invention.

FIG. 16 is computer simulation of magnetic field uniformity for a hypothetical MRI system similar to that of Example 1. The MRI system contains a permanent magnet assembly which includes a laminate of soft magnetic layers between the yoke and a permanent magnet body containing at least the base and the hollow ring sections. The total weight of each permanent magnet body is 2210 lb. The MRI system does not contain pole pieces.

The y-axis of FIG. 16 represents the M component of the magnetic field in the units of Tesla, and the x-axis represents the angle of measurement of the field (i.e., the location on the imaging volume having a radius of 15 cm). Thus, the curve in FIG. 16 represents the plot of the magnetic field around an outer periphery of the imaging volume. As can be seen from FIG. 16, the magnitude of the magnetic field varies from about 0.2234 Tesla at zero degrees to about 0.2283 Tesla at 90 degrees.

Figure 17:
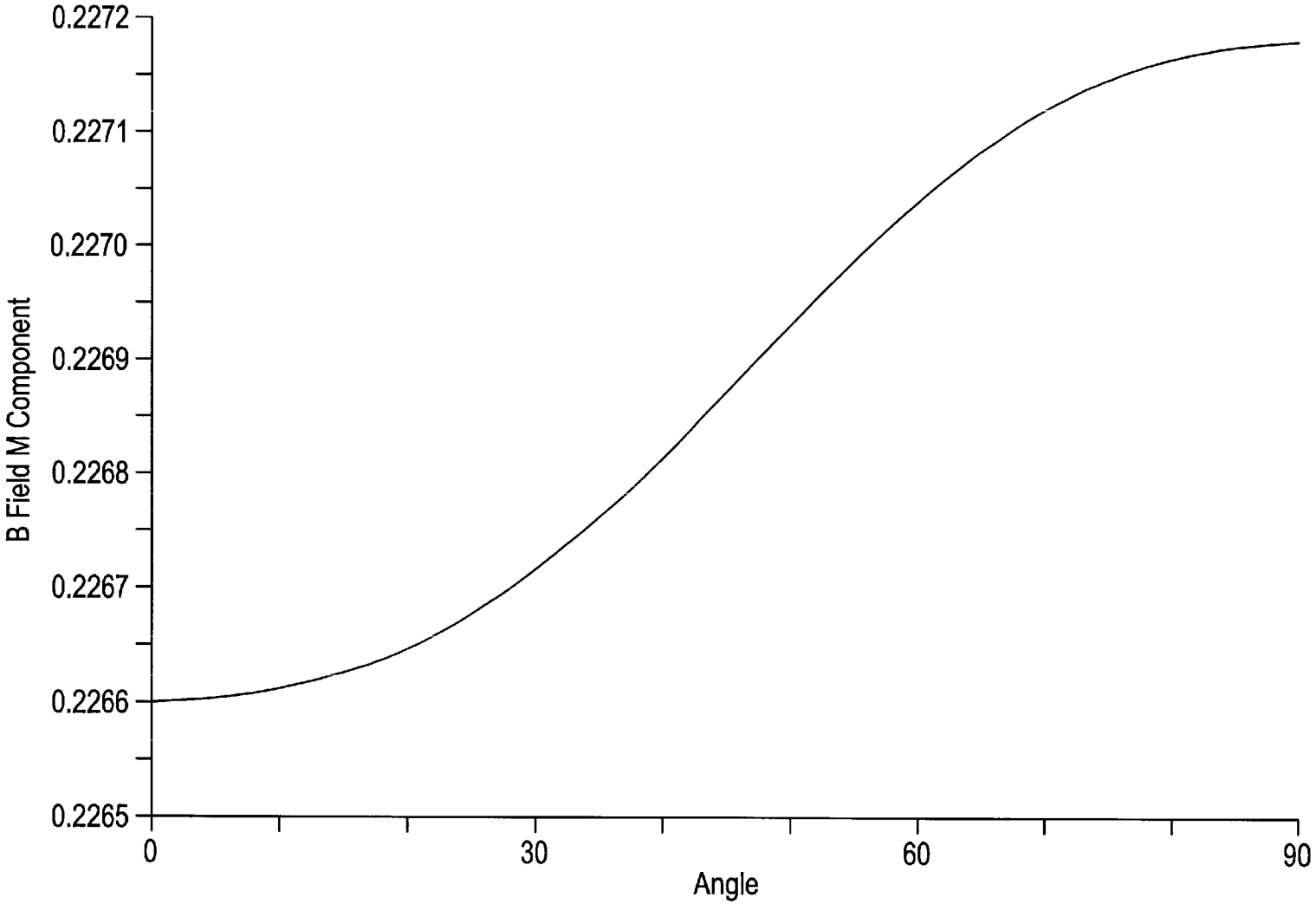
FIG. 17 is a plot of magnetic field versus position angle in an MRI system according to a comparative example.

FIG. 17 is a computer simulation of magnetic field uniformity for a hypothetical comparative MRI system similar to that of Example 2. The MRI system contains a permanent magnet assembly which includes parallelepiped permanent magnet bodies attached directly to the yoke and pole pieces comprising a laminate of soft magnetic layer adjacent to the imaging surface of the permanent magnet bodies (i.e., located between the imaging volume and the permanent magnet body). The total weight of each permanent magnet body is 2970 lb. The MRI system does not include a laminate of soft magnetic layers between the yoke and the permanent magnet body.

The y-axis of FIG. 17 represents the M component of the magnetic field in Tesla, and the x-axis represents the angle of measurement of the field (i.e., the location on the imaging volume having a radius of 15 cm). Thus, the curve in FIG. 17 represents the plot of the magnetic field around an outer periphery of the imaging volume. As can be seen from FIG. 17, the magnitude of the magnetic field varies from 0.2266 Tesla at zero degrees to about 0.2272 Tesla at 90 degrees.

Therefore, by adding the soft magnetic material layer(s) between the yoke and the magnets and by omitting the pole pieces, a significant reduction in MRI weight and cost may be achieved while improving the strength of the magnetic field in the imaging volume is improved. For example, the weight of each magnet may be reduced from 2970 to 2210 pounds (a weight reduction of about 26 percent), while maintaining about the same magnetic field strength (about 0.22 Tesla).

Example 3

A small experimental orthopedic MRI system for imaging the limbs and the head of a patient has been designed. The MRI system has a magnetic field strength of 0.5 Tesla. The permanent magnet assemblies of the MRI system include about a 5 cm thick laminate of amorphous iron soft magnetic layers between praseodymium rich RFeB permanent magnet bodies and the yoke. The magnet bodies included about 8 cm and about 6 cm thick disks and about a 4 cm thick ring, as shown in FIG. 3. The two magnet bodies together weighed 1,910 lb. The diameter of the permanent magnet assemblies was 67 cm. The permanent magnet assemblies were attached to a "C" shaped iron yoke. The total weight of the iron in the MRI system, including the yoke, was 6,030 lb., for a total magnet assembly/yoke weight of 7,940 lb. The permanent magnet assemblies were passively shimmed, but no pole pieces were used. The MRI contained a 27 cm horizontal patient gap. The total thickness of the top portion of the yoke and the magnet assembly was 100 cm. The 5G line from center (R×Z) was 1.0×1.2 meters. The uniformity of the magnetic field for a particular imaging volume was computed and the results are presented in Table 2, below.

TABLE 2

| Imaging volume (field of view) | Field uniformity in parts per million of Tesla |
|---|---|
| Sphere having a 15 cm diameter | 1 |
| Sphere having a 18 cm diameter | 7 |

Therefore, as may be seen from examples 1 and 3, a magnetic field uniformity of 0.5 to 1 ppm may be obtained for a spherical imaging volume having a diameter of 15 cm and a uniformity of 5–10 ppm may be obtained for a spherical imaging volume having a diameter of 18–20 cm.

The preferred embodiments have been set forth herein for the purpose of illustration. However, this description should not be deemed to be a limitation on the scope of the invention. Accordingly, various modifications, adaptations, and alternatives may occur to one skilled in the art without departing from the scope of the claimed inventive concept.

What is claimed is:

1. A method of making an imaging device, comprising:

providing a support comprising a first portion, a second portion and at least one third portion connecting the first and the second portions such that an imaging volume is formed between the first and the second portions;

attaching a first precursor body comprising a first unmagnetized material to the first support portion;

attaching a second precursor body comprising a second unmagnetized material to the second support portion;

magnetizing the first unmagnetized material to form a first permanent magnet body after the step of attaching the first precursor body; and magnetizing the second unmagnetized material to form a second permanent magnet body after the step of attaching the second precursor body.

2. The method of claim 1, wherein:

the step of magnetizing the first precursor body comprises placing a coil around the first precursor body; applying a pulsed magnetic field to the first precursor body to form at least one first permanent magnet body; and removing the coil from the first permanent magnet body; and the step of magnetizing the second precursor body comprises placing a coil around the second precursor body; applying a pulsed magnetic field to the second precursor body to form at least one second permanent magnet body; and removing the coil from around the second permanent magnet body.

3. The method of claim 2, wherein:

the step of placing a coil around the first precursor body comprises placing a first coil around the first precursor body; and the step of placing a coil around the second precursor body comprises placing a second coil around the second precursor body.

4. The method of claim 2, wherein:

the step of placing a coil around the first precursor body comprises placing a first coil around the first precursor body; and the step of placing a coil around the second precursor body comprises placing the first coil around the second precursor body after the step of placing the first coil around the first precursor body.

5. The method of claim 2, wherein:

the imaging system comprises a magnetic resonance imaging system;

the support comprises a yoke;

the first and the second unmagnetized bodies comprise an assembly of plurality of blocks having the same composition comprising an RMB alloy, where R comprises at least one rare earth element and M comprises at least one transition metal; and the pulsed magnetic field comprises a magnetic field of at least 2.5 Tesla.

6. The method of claim 5, the first and the second unmagnetized bodies comprise 13–19 atomic percent R, 4–20 atomic percent B and the balance M, where R comprises 50 atomic percent or greater Pr, 0.1–10 atomic percent of at least one of Ce, Y and La, and the balance Nd, and M comprises Fe.

7. The method of claim 5, further comprising:

placing the plurality of blocks of unmagnetized material on a second support prior to the step of attaching the first precursor body;

placing a cover over the blocks;

shaping the blocks to form the first precursor body prior to removing the cover and the second support;

removing the cover from the first precursor body;

providing an adhesive material to adhere the blocks to the first precursor body to each other; and removing the second support from the first precursor body.

8. The method of claim 7, wherein:

the second support and the cover comprise metal sheets; and the step of shaping comprises cutting the blocks into a desired shape using a water jet.

9. The method of claim 7, wherein:

the second support comprises a mold having a non-uniform cavity surface contour; and a first surface of the first precursor body forms a substantially inverse contour of the non-uniform mold cavity surface.

10. The method of claim 7, wherein the first precursor body comprises a cylindrical base magnet having opposite base surfaces and a side surface.

11. The method of claim 10, further comprising:

providing a first layer of adhesive material over a second base surface of the first precursor body;

attaching a cylindrical intermediate precursor body over the first layer of adhesive material, such that an exposed base surface of the intermediate precursor body contains a cylindrical cavity extending partially through a thickness of the intermediate precursor body;

providing a second layer of adhesive material over a periphery of the exposed surface of the intermediate precursor body;

attaching a hollow ring precursor body having a circular opening, opposite base surfaces and a side surface over the second layer of adhesive material.

12. The method of claim 1, further comprising attaching at least one layer of a soft magnetic material between the first precursor body and the first support portion.

13. The method of claim 12, wherein the at least one layer of a soft magnetic material comprises a laminate of Fe—Si, Fe—Al, Fe—Co, Fe—Ni, Fe—Al—Si, Fe—Co—V, Fe—Cr—Ni or amorphous Fe- or Co-base alloy layers.

14. The method of claim 1, further comprising providing an RF coil and an image processor to form a magnetic resonance imaging system.

15. The method of claim 1, wherein the support comprises a yoke, wherein the first and the second yoke portions comprise opposing plates supporting the first and second precursor bodies and the at least one third yoke portion comprises at least one bar connecting the first and second yoke portions.

16. The method of claim 2 further comprising providing liquid nitrogen around the coil during the step of applying a pulsed magnetic field.

17. An imaging device made by the method of claim 1.

18. A method of making a magnetic resonance imaging system, comprising:

providing a yoke comprising opposing plates and at least one bar connecting the first and second plates, such that an imaging volume is formed between the first and the second opposing plates;

attaching a first precursor body comprising a first unmagnetized material to the first plate;

placing a coil around the attached first precursor body;

applying a pulsed magnetic field to the first precursor body to form at least one first permanent magnet body;

removing the coil from around the first permanent magnet body;

attaching a second precursor body comprising a second unmagnetized material to the second plate;

placing a coil around the attached second precursor body;

applying a pulsed magnetic field to the second precursor body to form at least one second permanent magnet body; and removing the coil from around the second permanent magnet body.

19. The method of claim 18, wherein:

the step of placing a coil around the attached first precursor body comprises placing a first coil around the attached first precursor body;

the step of placing a coil around the attached second precursor body comprises placing the first coil around the attached second precursor body after the step of placing the first coil around the attached first precursor body; and the steps of attaching the first precursor body and attaching the second precursor body occur before the step of placing the first coil around the attached first precursor body.

20. A method of making a magnetic resonance imaging system, comprising:

providing a yoke comprising opposing plates and at least one bar connecting the first and second plates, such that an imaging volume is formed between the first and the second opposing plates;

attaching at least one first layer of soft magnetic material to the first plate;

attaching a first precursor body comprising an unmagnetized RMB alloy, where R comprises at least one rare earth alloy and M comprises at least one transition metal, to the first plate, such that the at least one first layer of soft magnetic material is located between the first plate and the first precursor body;

placing a coil around the attached first precursor body;

applying a pulsed magnetic field to the first precursor body to form at least one first permanent magnet body;

removing the coil from around the first permanent magnet body;

attaching at least one second layer of soft magnetic material to the second plate;

attaching a second precursor body comprising an unmagnetized RMB alloy, where R comprises at least one rare earth alloy and M comprises at least one transition metal, to the second plate, such that the at least one second layer of soft magnetic material is located between the second plate and the second precursor body;

placing a coil around the attached second precursor body;

applying a pulsed magnetic field to the second precursor body to form at least one second permanent magnet body; and removing the coil from around the second permanent magnet body.

21. The method of claim 20, wherein:

the step of placing a coil around the attached first precursor body comprises placing a first coil around the attached first precursor body;

the step of placing a coil around the attached second precursor body comprises placing the first coil around the attached second precursor body after the step of placing the first coil around the attached first precursor body; and the steps of attaching the first precursor body and attaching the second precursor body occur before the step of placing the first coil around the attached first precursor body.

* * * * *